United States Patent [19]

Schliep

[11] 4,366,732

[45] Jan. 4, 1983

[54] ADJUSTABLE SOCKET WRENCH

[76] Inventor: Edward J. Schliep, 3218 Twin City Dr., Mandan, N. Dak. 58554

[21] Appl. No.: 167,003

[22] Filed: Jul. 9, 1980

Related U.S. Application Data

[63] Continuation-in-part of Ser. No. 85,381, Oct. 16, 1979, abandoned.

[51] Int. Cl.[3] ..... B25B 13/18

[52] U.S. Cl. ..... 81/128; 279/64; 279/69

[58] Field of Search ..... 81/53.2, 128, 113; 279/40, 65, 69, 122, 64

[56] References Cited

U.S. PATENT DOCUMENTS

| | | | |
|---|---|---|---|
| 876,244 | 1/1908 | Shigon | 279/64 |
| 885,926 | 4/1908 | Horst | 279/64 |
| 1,279,950 | 9/1918 | Wenzel | 81/113 |
| 1,318,090 | 10/1919 | Nebel | 279/64 |
| 1,760,338 | 5/1930 | Billmyer | 81/113 |
| 2,350,426 | 6/1944 | Thompson | 279/65 X |
| 2,378,188 | 6/1945 | Clarke | 279/65 |
| 2,582,444 | 1/1952 | Lucht | 81/128 |
| 4,213,355 | 7/1980 | Colvin | 81/128 |

FOREIGN PATENT DOCUMENTS

| | | | |
|---|---|---|---|
| 436882 | 4/1912 | France . | |
| 418684 | 3/1947 | Italy | 279/65 |

*Primary Examiner*—James G. Smith

*Attorney, Agent, or Firm*—Schwartz, Jeffery, Schwaab, Mack, Blumenthal & Koch

[57] ABSTRACT

An adjustable socket wrench having a socket head at one end with a recess adapted to receive a socket handle at the other end. The socket head is formed with a plurality of arcuately spaced openings which extend entirely through said socket head, and a plurality of gripping jaws fit relatively closely within and extend through the openings. Means are provided to operatively connect the wrench housing and the jaws for moving the jaws either toward or away from each other thereby to accommodate and tightly engage varying size objects to be rotated by the wrench.

6 Claims, 9 Drawing Figures

ADJUSTABLE SOCKET WRENCH

CROSS-REFERENCE TO RELATED APPLICATION

This application is a continuation-in-part of my application Ser. No. 085,381, filed Oct. 16, 1979, now abandoned.

BACKGROUND OF THE INVENTION

The present invention relates as indicated to an adjustable socket wrench, and more particularly to a socket wrench which has adjustably movable jaws to accommodate and closely engage upon adjustment the exterior surfaces of nut members or the like to be rotated by the wrench.

Adjustable socket wrenches of the type referred to are well known in the art. U.S. Pat. No. 1,279,950 to Wenzel, for example, discloses a wrench having a plurality of gripping jaws each of which is operatively connected to an arm in turn pivotally secured to an adjusting nut. The nut threadedly engages an elongated threaded shank, and adjustment of the nut upwardly or downwardly relative to the jaws serves to cause the jaws to converge or diverge so as to permit the proper spacing of the jaws for snugly fitting around the member to be engaged by the wrench. U.S. Pat. No. 1,760,338 by Billmyer, Jr. similarly discloses an adjustable wrench having a plurality of gripping jaws, with the jaws being carried by arms which are pivotally connected to a core threadedly engaged with a shank the upper end of which contains an adjusting knob. By rotating the knob, the core moves upwardly and downwardly thereby resulting in the movement of the gripping jaws toward or away from each other depending upon the direction of movement. French Pat. No. 436,882 also discloses gripping jaws pivotally carried by a core member threadedly engaged with a shank the rotation of which moves the core and consequently the jaws inwardly or outwardly relative to each other.

In all of the above arrangements, the gripping jaws are relatively isolated from their supporting structure, As a result, excessive torque is applied to the gripping jaws when the wrench is used in the normal manner of tightening or loosening a nut member or the like. It will be understood in this regard that the wrench is normally actuated, as shown in the patents referred to, by means provided at the end of the wrench opposite to the gripping jaws, either by an integral handle or a socket opening in which a separate socket can be engaged. When the supporting structure for the jaws rotates, such rotation is of course transmitted to the gripping jaws, but the lack of support for the gripping jaws in the gripping regions results in excessive torque on the gripping jaws which in turn leads either to limited use of the adjustable wrench or premature structural failure thereof.

SUMMARY OF THE INVENTION

With the above in mind, a principal object of the invention is to provide an adjustable socket wrench in which the gripping jaws are closely associated with a socket housing so that the torque resulting from the gripping action applied to the jaws during use of the wrench is effectively and substantially entirely transferred to the socket housing thereby substantially increasing the torque-absorbing abilities of the wrench. In accordance with the invention, the gripping jaws extend, preferably at an angle, through openings provided therefor in the forward end of the socket housing, with the gripping jaws engaging the walls of the openings regardless of the position of adjustment of the gripping jaws thereby effecting the desired torque absorption by the socket housing regardless of the position of the jaws. In the preferred form of the invention, the jaws, when fully retracted within the socket housing, form a substantially continuous surface with the adjoining walls of the socket housing, with the jaws upon movement to a relatively more closed position extending outwardly and radially inwardly relative to the wall of the socket housing through which the openings for the jaws are formed.

A further feature of the invention is a provision of preferably resilient means for continually engaging and biasing the gripping jaws in a radially outward direction thereby ensuring firm engagement of the surface of the gripping jaws with the walls of the openings formed in the socket head through which the jaws extend. In this manner, the torque placed on the gripping jaws during use of the wrench is effectively transferred to the socket housing. By virtue of the novel construction of the gripping jaws and the manner in which they extend through the socket housing, socket wrenches of essentially any size can be provided, all of which have the same torque-absorbing characteristics. This is a substantial improvement over prior art devices which were effectively limited in terms of torque-absorption due to the manner in which the jaws were mounted.

A further feature of the invention is the manner in which the lower ends of the gripping jaws are mounted for adjustable movement relative to the socket head. In accordance with the one form of the invention, the jaws are carried between pairs of flanges formed on a collar which is operatively connected to an adjusting nut. The latter threadedly engages a shank portion of the socket housing whereby adjustable movement of the nut results in movement of the collar and consequent movement of the gripping jaws. Thus, a direct and positive translation of movement is effected between rotation of the adjusting nut and generally axial movement of the gripping jaws.

In accordance with another form of the invention, the gripping jaws are pivotally connected to arms which extend partially through the interior of the socket housing so as to minimize the exterior dimension of the wrench, and to improve the aesthetics thereof.

These and other objects of the invention will become apparent as the following description proceeds in particular reference to the application drawings.

BRIEF DESCRIPTION OF THE APPLICATION DRAWINGS

DETAILED DESCRIPTION OF THE PREFERRED EMBODIMENTS

Figure 1:
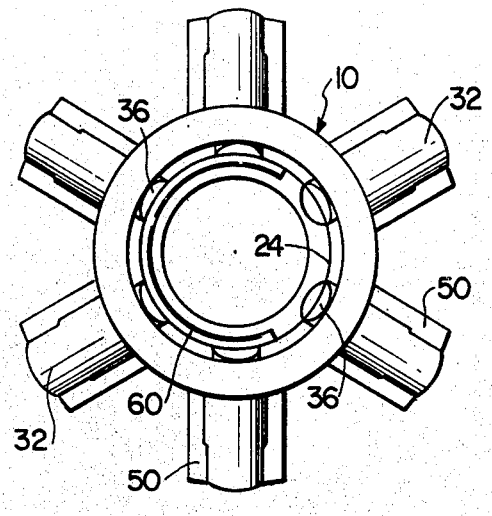
FIG. 1 is a top plan view of the adjustable socket wrench in accordance with one form of the present invention.

Referring now in more detail to the application drawings, wherein like parts are indicated by like reference numerals, and initially to the form of the invention shown in FIGS. 1–5, the adjustable socket wrench comprises a socket housing generally indicated at 10 which includes a socket head 12 which, in the form shown, is integrally formed with a threaded shank section 14. The end 16 of the socket housing opposite to the socket head 12 is formed with an opening 18 which can be rectangular, hexagonal or of any desired cross-section to accommodate the head 20 of a socket handle 22.

The socket head 12 is generally cup-shaped in cross-section, although it will be understood that any cross-sectional configuration could be employed consistent with the basic concepts of the invention. The socket head 12 is formed with an opening 24 generally circular in cross section, with the bottom of such opening terminating in a shoulder 26 which merges into a further opening 28. Thus, the opening 24 and shoulder 26 can be conveniently formed in the socket head by countersinking after the original opening 28 has been formed.

Figure 2:
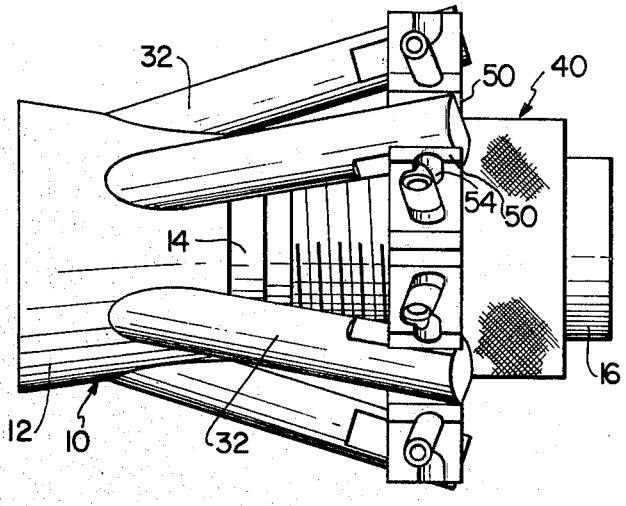
FIG. 2 is a side elevational view of the wrench of FIG. 1.
Figure 3:
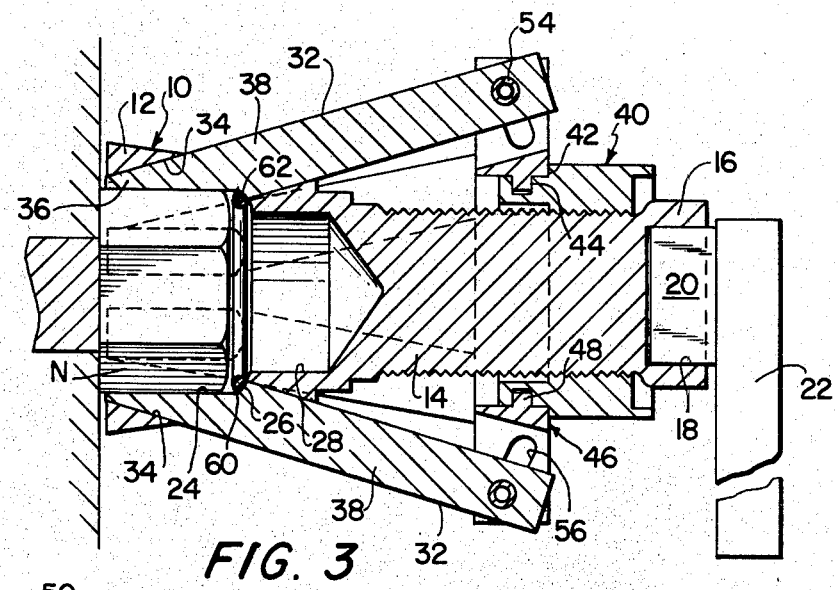
FIG. 3 is a cross-sectional view through the wrench of FIG. 1, with the gripping jaws shown positioned around a nut member to be loosened or removed by the wrench, with the opposite end of the socket housing being engaged by a socket handle.
Figure 4:
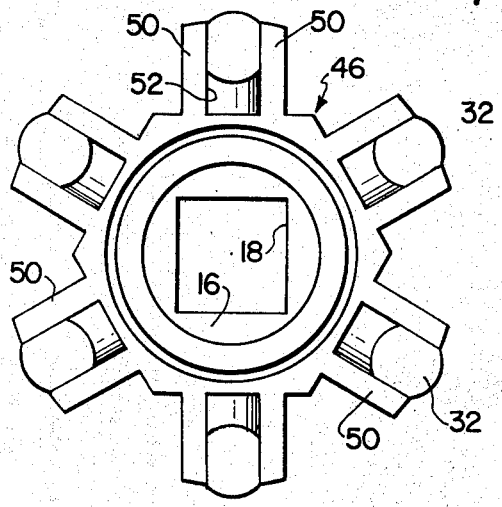
FIG. 4 is a bottom plan view of the wrench of FIG. 1.
Figure 5:
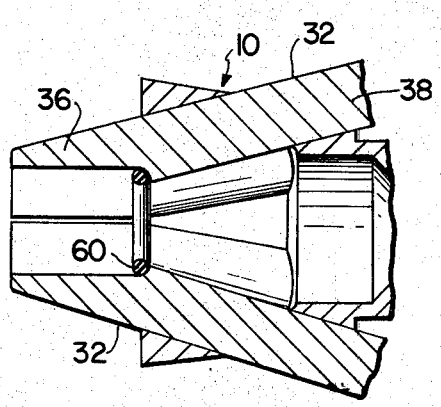
FIG. 5 is a fragmentary sectional view of the FIG. 1 form, showing the gripping jaws in their most closed position of adjustment.

A plurality of gripping jaws commonly designated at 32 are provided, there being six jaws illustrated in FIGS. 1–5. Each jaw extends through an opening 34 provided therefor in the socket head 12, with the openings 34 being at an angle relative to the axis of the socket head. As best shown in FIGS. 3 and 5, each gripping jaw 32 includes a tapered leading end portion 36 and a cylindrical portion 38. In FIG. 3, the gripping jaws 32 are shown in their most withdrawn position wherein the inner faces of the tapered wall sections 36 are substantially in the same plane as the walls of the circular opening 24 formed in the socket head 12. The gripping jaws 32 are shown in their fully extended, or most closed, position in FIG. 5.

In order to move the gripping jaws 32 between the FIG. 3 and FIG. 5 positions thereof, an adjusting nut generally indicated at 40 is provided, with the nut being generally cylindrical and internally threaded so as to mate with the exterior threads on the shank 14 of the socket housing. As can be seen in FIG. 2, the exterior surface of the adjusting nut is preferably knurled or otherwise disfigured so as to facilitate rotation of the nut along the shank 14.

The adjusting nut 40 is formed with a first annular recess 42 and a second radial recess or groove 44 formed relatively adjacent the forward end of the nut. A collar generally illustrated at 46 is mounted around the nut, with the collar being formed with a tongue 48 which fits into the groove 44. In this manner, the collar 46 is carried by the adjusting nut as the latter moves axially upwardly or downwardly along the shank 14 of the socket housing, while at the same time allowing rotation of the nut 40.

Positioned at spaced intervals around the periphery of the collar 46 are radially outwardly directed flanges commonly indicated at 50. Each pair of adjacent flanges forms therebetween an opening between which extends the lower end of each gripping jaw 32, with such lower end being flattened in such region as shown in FIGS. 1 and 4. A pin 54 is positioned adjacent the bottom of each gripping jaw in an opening formed in the flattened region therof, as shown in FIG. 2. Each flange 50 is formed with a curved slot or track 56 in which the opposite ends of each pin 54 engage whereby the lower ends of the jaws are capable of undergoing radial movement to accommodate adjustment of the gripping jaws between their FIGS. 3 and 5 positions.

An important feature of the FIGS. 1–5 form of the present invention is the maintaining of the gripping jaws in solid line contact with the outer wall surfaces of the openings formed in the socket head through which the jaws extend. This is accomplished by the provision of a resilient washer 60 which is positioned on a narrow shoulder portion 62 formed where the tapered portions 36 of the jaws merge into the cylindrical portions thereof. The washer 60 functions as resiliently bias the jaws outwardly so that in the FIG. 3 position of the gripping jaws, the radially outer peripheral surface of each jaw is in solid line contact with the adjacent wall portion of the opening 34 through which the jaw extends. As the jaws are moved toward a more converging or closed position, as shown in FIG. 5, the resilient washer 60 is compressed and still resiliently urges the walls of the gripping jaws against the socket head openings. This is very desirable since the torque on the gripping jaws during use of the wrench is effectively and essentially totally transferred to the socket head 12 and thus the socket housing, which by its construction is capable of absorbing such torque during all normal uses of the device.

The use of the adjustable socket wrench as above described is shown in FIG. 3, wherein the jaws are shown in their most open position, and the wrench is positioned around a nut N to be removed. Although the gripping jaws are shown essentially totally withdrawn, it will be understood that the jaws have been moved by the adjusting nut 40 in the manner above described so as to tightly engage the peripheral surfaces of the nut. The head 20 of the socket handle 22 is then placed in the opening 18 of the end 16 of the socket housing and the housing rotated counterclockwise in the usual manner. The force required to rotate and thus loosen the nut end is transferred to the socket housing by virtue of the novel mounting of the gripping jaws relative to the socket head, and the biasing of the gripping jaws against the openings in the socket head.

To accommodate fastener nuts of smaller dimension, the adjusting nut 40 is moved axially along the shank 14 toward the socket head, thereby resulting in movement of the collar 46 and thus the gripping jaws which are pivoted on the collar flanges 50. Continued rotation of the adjusting nut in the indicated direction brings the inner faces of the gripping jaws into tight contact with the nut member, and the wrench is thereafter rotated by the socket head in the direction desired. It will be noted that there are six gripping jaws, whereby the inner faces of the tapered ends of each jaw can conveniently engage each face of a hexagonal nut. Due to the tongue and groove 48 and 44, respectively, the nut 40 is able to rotate relative to the collar 46, while simultaneously moving both the collar and nut axially.

Reference is now made to the form of the invention illustrated in FIGS. 6–9. It will be noted that this modification is similar in several respects to the modifications illustrated in FIGS. 1–5, but several important differences exist. Although the gripping jaws extend through openings formed in the socket housing as in the form just described, the gripping jaws are relatively abbreviated relative to the earlier form, and are pivotally connected to actuator arms which extend longitudinally interiorally of the socket housing. This provides a wrench of more compact exterior dimension and improves the appearance of the wrench inasmuch as certain of the movable, actuating components are not visible at the exterior of the wrench. In addition, the actuator arms are moved longitudinally by a plate which is operatively connected to a collar or sleeve which threadedly engages the exterior threaded portion of the rear part of the socket housing.

Figure 9:
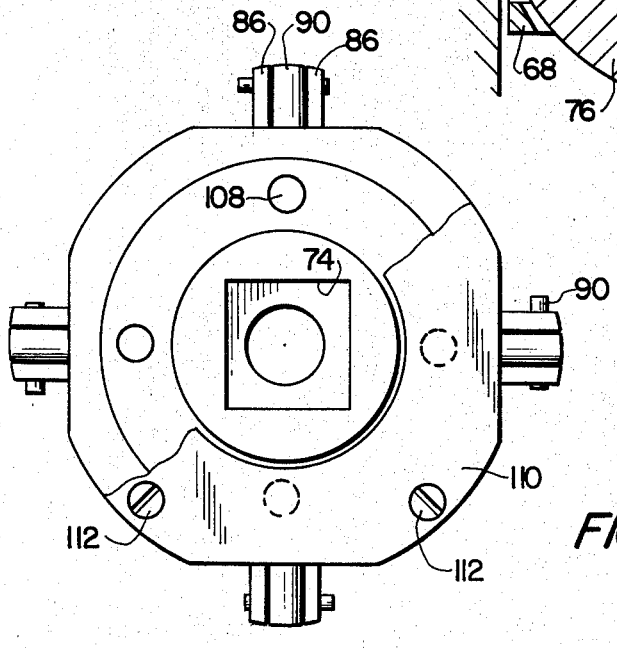
FIG. 9 is a bottom plan view of the FIG. 6 form of the invention.

The socket housing is generally indicated at 66 and comprises a leading or outer end 68 which is in the form of a cylindrical sleeve, and a relatively thicker intermediate and rear end portion 70. A reduced diameter portion 72 is formed centrally of the housing, and a still further reduced opening 74 is formed in the outermost portion of the socket housing, in order to receive the head 20 of the socket handle 22. As can be seen in FIG. 9, the opening 74 is shown rectangular in form, although it will be understood that other non-circular forms could be provided as well to accommodate varying shape socket heads.

Figure 6:
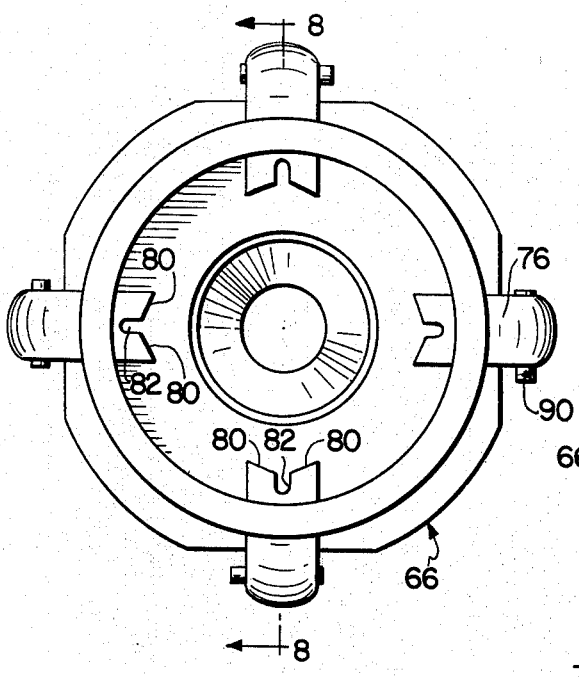
FIG. 6 is a top plan view of a modified form of the invention.
Figure 7:
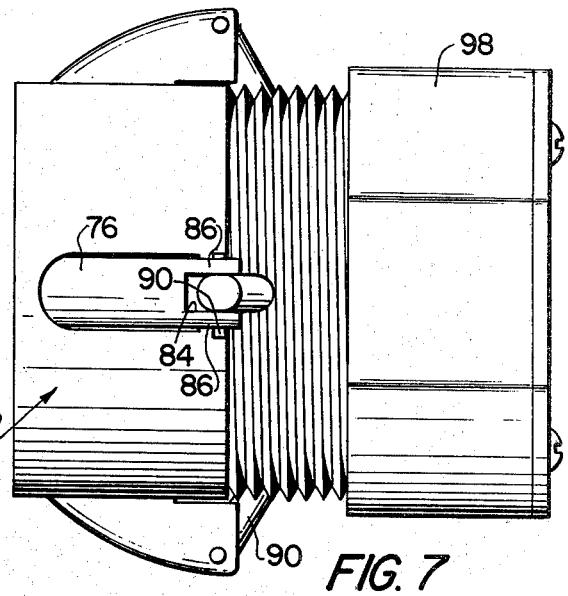
FIG. 7 is a side elevational view of the FIG. 6 modification.

A plurality, there being four in the form shown, of gripping jaws commonly designated at 76 are provided, with the jaws being generally triangular shape in side elevational view and provided with front gripping faces 78, the configuration of which can best be seen in FIG. 6. The leading faces preferably comprise separate wall sections commonly designated at 80 formed by cutting a slot 82 in the leading face of the jaws, with the two walls 80 advantageously providing narrow gripping faces so as to better engage and grip the nut end to be engaged and rotated by the wrench.

Each gripping jaw is formed with an opening 82 (FIG. 7) at the trailing edge thereof, with the radial dimension of the walls 86 on either side of the opening 84 being abbreviated relative to the radial dimension of the gripping portions of the jaws 76. The actuating arms are commonly designated at 88, each of which includes a leading end portion 90 which is somewhat flattened at the ends thereof for positioning in the slot 84 formed in the end of the gripping jaw. A pin 90 extends through openings formed in the walls 86 of the jaw and an aligned opening formed in the end 90 of the actuating arm thereby pivotally connecting the gripping jaws to the actuator arms.

The intermediate portion of the socket body is formed with four slots commonly designated at 92 in which the leading ends 90 of the actuator arm are positioned and adapted for longitudinal movement relative to the socket housing. As will be presently described, longitudinal movement of the generally circular portions 94 of the actuator arms causes the gripping jaws to be moved between their most withdrawn position, shown in solid lines in FIG. 8, and adjusted, pivotally radially inwardly positions, one of which is shown in dashed lines in FIG. 8.

The circular portions 94 of the actuator arms extend through cylindrical openings 96 formed in the socket housing, with the openings 96 being slightly larger in diameter than the diameter of the portions 94 of the arms so as to permit longitudinal movement of the arms without interference. The tolerance is such, however, that the arm portions 94 move essentially linearly so as to be immediately and positively responsive to adjustment.

A collar or sleeve 98 is positioned around the socket housing at the outer end thereof, with the collar being formed with threads 100 for threadedly engaging the threaded intermediate portion of the socket housing, whereby the collar or sleeve can be axially adjusted or moved relative to the housing. The collar is relatively enlarged at its extreme outer end as shown at 102, and is formed with a further enlarged annular shoulder 104 the outer face of which serves as a contacting surface for the contiguous face of an annular washer 106. The latter is formed with a plurality of arcuately spaced openings corresponding in number and location to the actuator arms 88, with the outer ends of the circular portions 94 of the arms extending through such openings and being provided with weldments commonly indicated at 108 slightly larger than the openings formed in the washer 106. The washer 106 is thus retained in place following assembly of the components and forming the weldments 108.

An outer cap 110 is positioned on the rear face of the collar, with the cap being secured to the collar by threaded bolts commonly designated at 112. The exterior dimension and configuration of the cap 110 corresponds to the dimension and configuration of the collar 98, with these members in the form shown being generally octagonal in exterior configuration. However, it will be understood that circular or other non-circular outer surfaces could be provided, and that the collar 98 can be knurled or disfigured in some other manner as previously described to facilitate gripping of the collar for axial adjustment thereof relative to the socket housing. It will further be noted, referring to FIG. 9, that the actuator arms 88 and weldments 108 at the end thereof are arcuately spaced so as to be staggered from the bolts 112 so as to not to interfere with the attachment of the cap to the socket housing.

Figure 8:
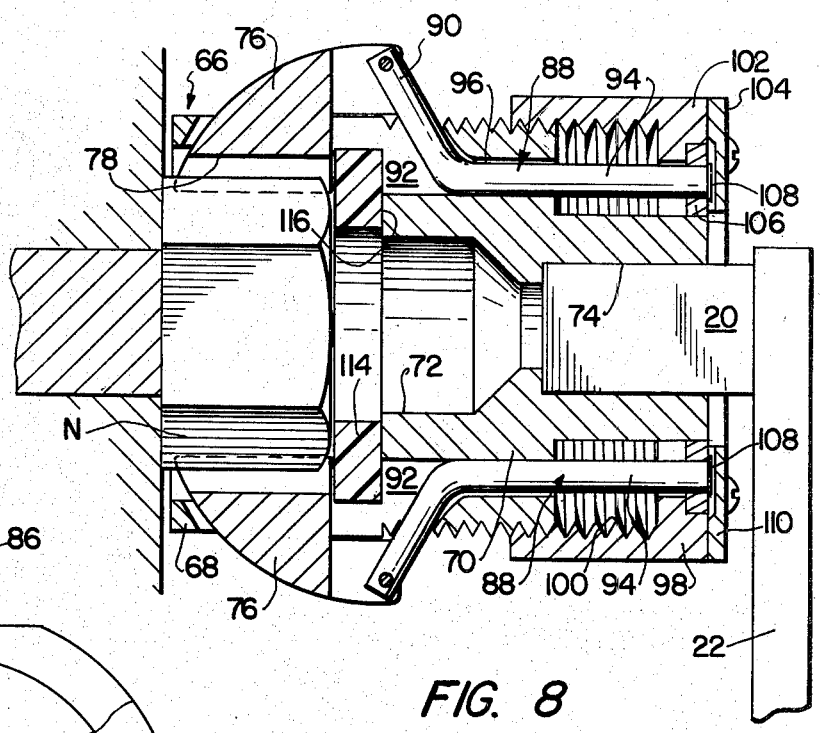
FIG. 8 is a cross-sectional view taken on line 8—8 of FIG. 6.

A resilient washer 114 is positioned on the surface 116 of the intermediate portion of the socket housing and serves to provide a resilient surface against which the gripping jaws engage when in their most withdrawn position, shown in solid lines in FIG. 8. In such position, the washer 114 is compressed thereby serving to maintain the jaws in a fairly firm position. This reduces tension on the pivotal connection between the gripping jaws and the actuator arms.

The wrench is assembled as follows. The actuating arms are inserted through the socket housing, and the gripping jaws 76 are thereafter positioned through the openings therefor in the leading end of the housing. The pins 86 are thereafter positioned through the aligned openings in the cooperable parts of the gripping jaws and actuator arms. The collar is then rotated on the threaded portion of the socket housing, and the washer 106 positioned against the front surface of the shoulder 104 formed on the collar. Weldments 108 are thereafter formed on the exposed rear faces of the actuator arms thereby locking the washer 106 in place. The cap 110 is then secured to the collar by fastening bolts 112 which completes the assembly.

When the collar 98 is moved axially along the socket housing, the relative position of the gripping jaws is varied. As shown in FIG. 8, the gripping jaws are in essentially their most withdrawn position. When the collar is advanced forwardly, or to the left as viewed in FIG. 8, the actuator arms are likewise moved axially forwardly, and since the actuator arms were maintained against radial movement, the pivotal connection between the actuator arms and the gripping jaws results in the latter being forced pivotally radially inwardly as shown in dashed lines in FIG. 8. The extent to which the jaws can be moved inwardly depends upon the axial travel of the collar and the actuator arms carried thereby. Thus, the gripping jaws can be adjusted to very securely grip any nut which is desired to be removed, within the limits of travel of the gripping jaws. In view of the pivotal connection of the jaws to the actuator arms, and the positioning of the portions 94 of the arms within the openings formed in the socket housing, the rotational torque developed during removal of the nut is effectively transferred from the jaws to the arms and thus to the socket housing. A very effective and strong gripping action is therefore provided.

To withdraw the gripping jaws, the collar 98 is simply moved rearwardly, or to the right as viewed in FIG. 8. The shoulder 104 forces the washer 106 rearwardly, with the washer in turn engaging the radially outer portions of the weldments 108 to move the actuator arms in the same direction.

It will thus be seen that by axial movement of the collar 98 in either direction, the gripping jaws can be quickly and easily pivotally radially adjusted to firmly grip the surface of the nut end. The socket head 20 is thereafter positioned in the opening 74 and the wrench rotated to lossen the nut.

The FIGS. 6–9 form of the invention is particularly characterized by its more compact configuration, by virtue of location of major lengths of the actuator arms within the socket housing and collar.

It will be understood by those skilled in the art that modifications of the invention as above described can be made without, however, departing from the invention concepts. For example, a gauge could be associated with the adjusting nut to indicate the spacing beween the movable gripping jaws and thus the diameter of nut member which can be positioned within the gripping jaws at that position of adjustment.

I claim:

1. An adjustable socket wrench comprising:

(a) a socket housing having a socket head at one end thereof with a recess adapted to receive a socket handle at the other end thereof, and including a threaded shank, (b) said socket head being formed with a plurality of arcuately spaced openings which extend entirely through said socket head, (c) a plurality of gripping jaws fitting relatively closely within and extending through said openings adapted to engage the exterior surface of a nut member, (d) means operatively connected between said housing and said jaws for moving said jaws either toward or away from each other thereby to accommodate and tightly engage varying size nut members to be rotated by said wrench, said means operatively connected between said housing and said jaws for moving said jaws comprising a plurality of actuator arms corresponding in number to said gripping jaws, with the leading ends of said actuator arms being pivotally connected to said gripping jaws whereby said axial movement of said actuator arms results in pivotally radially inward movement of said gripping jaws.

2. The adjustable socket wrench of claim 1 wherein each of said actuator arms comprises a radially outwardly inclined leading end portion positioned in a slot defined by two arms in the rear portion of the associated gripping jaw, and a generally axially extending cylindrical portion extending through an opening provided therefor in said socket housing, with said socket housing being formed with a plurality of peripheral slots to receive the leading ends of said actuator arms.

3. The adjustable socket wrench of claim 1 wherein said means for moving said jaws includes a collar threadedly engaged with the exterior of said housing in the rear portion thereof, and means for operatively connecting said collar to said actuator arms for simultaneous axial movement.

4. The adjustable socket wrench of claim 3 wherein said means for operatively connecting said collar to said actuator arms comprises a washer formed with openings through which the cylindrical portions of said actuator arms extend, said washer being positioned in an annular recess formed in said collar, and cap means mounted on the rear face of said collar and enclosing said actuator arms and said washer.

5. The adjustable socket wrench of claim 1 wherein said gripping jaws are generally triangular shape in cross-section, with the face of each jaw positioned within said socket head extending substantially the entire length of said socket head thereby to provide a relatively long gripping surface.

6. The adjustable socket wrench of claim 5 wherein the leading face of each gripping jaw is formed of two generally inclined wall segments separated by a slot, with the separated wall segments serving to provide better line contact with the nut to be gripped.

* * * * *